US007124474B2

(12) United States Patent
Nicolay et al.

(10) Patent No.: US 7,124,474 B2
(45) Date of Patent: Oct. 24, 2006

(54) ADJUSTABLE TOOL HANDLE FOR PAINT ROLLERS AND THE LIKE

(75) Inventors: Kenneth M. Nicolay, Fairway, KS (US); Lewis A. Mendelson, Overland Park, KS (US); Lawrence E. Guerra, Mission, KS (US)

(73) Assignee: Nicolay Family Enterprises, L.L.C., Fairway, KS (US)

( * ) Notice: Subject to any disclaimer, the term of this patent is extended or adjusted under 35 U.S.C. 154(b) by 0 days.

(21) Appl. No.: 10/824,089

(22) Filed: Apr. 14, 2004

(65) Prior Publication Data

US 2005/0229361 A1 Oct. 20, 2005

(51) Int. Cl.
*A45C 3/00* (2006.01)

(52) U.S. Cl. ..... 16/436; 294/57; 15/144.4

(58) Field of Classification Search ..... 16/110.1, 16/422, 425, 426, 427, 429, 430, 436, 438, 16/446, 112, 115; 294/54.5, 58, 49, 57; 15/143.1, 15/144.4, 145

See application file for complete search history.

(56) References Cited

U.S. PATENT DOCUMENTS

| | | | | | |
|---|---|---|---|---|---|
| 171,325 | A | | 12/1875 | Smith | |
| 271,303 | A | | 1/1883 | Blaker | |
| 666,633 | A | | 1/1901 | Farmer | |
| D39,441 | S | | 8/1908 | Bain | |
| 930,660 | A | | 8/1909 | Gifford | |
| 1,032,535 | A | | 7/1912 | Ettinghaus | |
| 1,151,012 | A | * | 8/1915 | Herringstad | 294/58 |
| 1,207,472 | A | | 12/1916 | Barton | |
| 1,486,758 | A | | 3/1924 | Jerram | |
| 1,519,892 | A | | 12/1924 | Webster | |
| 1,901,778 | A | | 3/1933 | Schlag | |
| D123,113 | S | | 10/1940 | Loud | |
| D153,070 | S | | 3/1949 | Lund | |
| 2,539,087 | A | * | 1/1951 | Kramer | 15/145 |
| 2,545,585 | A | | 3/1951 | Montague | |
| 2,629,624 | A | | 2/1953 | Nelles | |
| 2,677,838 | A | * | 5/1954 | Jouban | 15/120.2 |
| 2,852,872 | A | | 9/1958 | Benz | |
| 2,933,836 | A | | 4/1960 | McKinley | |
| 3,014,750 | A | * | 12/1961 | Briggs | 294/58 |
| 3,023,021 | A | | 2/1962 | Fricke | |
| 3,136,574 | A | | 6/1964 | Pasquale | |
| 3,223,383 | A | | 12/1965 | Hrabal | |
| 3,981,043 | A | | 9/1976 | Curry | |
| 4,125,951 | A | | 11/1978 | Huerth | |
| 4,128,266 | A | * | 12/1978 | Vaslas | 294/58 |
| 4,198,090 | A | * | 4/1980 | Gutman | 294/58 |
| 4,229,033 | A | * | 10/1980 | Vosbikian | 294/58 |

(Continued)

*Primary Examiner*—Robert J. Sandy
*Assistant Examiner*—Andre' L. Jackson
(74) *Attorney, Agent, or Firm*—Erickson & Kleypas, LLC

(57) ABSTRACT

A tool handle assembly adapted to be connected to a tool head comprises a leg with an inner grip handle connected to the leg between first and second ends thereof, an outer grip handle connected to the first end of the leg and a tool head connector connected to the second end of the leg. The inner grip handle includes a grip extending perpendicular to the leg. The outer grip handle preferably pivots about an axis extending perpendicular to an axis extending through the leg. The inner grip handle is preferably pivotal between a storage and use position and is slidably connected to the leg. The leg of the tool handle preferably telescopes and comprises a pair of parallel extending legs connected together by cross-members.

13 Claims, 7 Drawing Sheets

U.S. PATENT DOCUMENTS

| | | | | | |
|---|---|---|---|---|---|
| 4,354,702 | A | | 10/1982 | Clements | |
| 4,441,746 | A | * | 4/1984 | Corboy, Jr. | 294/24 |
| 4,669,206 | A | | 6/1987 | Yost | |
| 4,705,312 | A | * | 11/1987 | Vooge et al. | 294/62 |
| D305,603 | S | | 1/1990 | Nelson | |
| 5,016,319 | A | * | 5/1991 | Stigen | 16/426 |
| 5,048,883 | A | * | 9/1991 | Waluk | 294/54.5 |
| 5,133,101 | A | * | 7/1992 | Hauser et al. | 15/143.1 |
| D333,074 | S | | 2/1993 | Ciccarelli | |
| 5,197,772 | A | | 3/1993 | Stecyk | |
| 5,395,147 | A | | 3/1995 | Brown | |
| 5,499,852 | A | | 3/1996 | Seigendall | |
| D380,360 | S | | 7/1997 | Scruggs | |
| 5,669,163 | A | | 9/1997 | Winter | |
| 5,782,518 | A | | 7/1998 | Scruggs | |
| 5,887,920 | A | | 3/1999 | Perciful | |
| 5,921,600 | A | * | 7/1999 | Lucas | 294/58 |
| 5,974,775 | A | | 11/1999 | Niehuss | |
| 6,062,619 | A | | 5/2000 | Clark, Jr. | |
| 6,082,795 | A | * | 7/2000 | Fornelli | 294/58 |
| D447,534 | S | | 9/2001 | Wackowski et al. | |
| 6,343,822 | B1 | * | 2/2002 | Badura | 294/58 |
| 6,360,402 | B1 | * | 3/2002 | Crabtree | 16/430 |
| 6,397,711 | B1 | * | 6/2002 | Marek | 81/489 |
| 6,487,747 | B1 | | 12/2002 | Cavalheiro | |
| 6,592,160 | B1 | * | 7/2003 | Nicolay et al. | 294/57 |
| D484,023 | S | | 12/2003 | Stout | |
| 2003/0132079 | A1 | * | 7/2003 | Bellini | 190/115 |

* cited by examiner

ADJUSTABLE TOOL HANDLE FOR PAINT ROLLERS AND THE LIKE

BACKGROUND OF THE INVENTION

1. Field of the Invention

This invention relates to an improved handle for use on tools such as paint rollers, brooms, rakes, hoes, mops and the like.

2. Description of the Related Art

In U.S. Pat. No. 6,592,160, an improved tool handle was disclosed which was particularly well adapted for use in association with shovels. The present invention is directed to further improvements to such a tool handle for tools which are used by employing a sweeping type motion such as brooms, paint rollers, mops, rakes and hoes. Such tools typically have handles comprising a single straight shaft which is secured to a head of the tool along a central axis of the tool head.

Although simple to manufacture, the conventional single, straight shaft tool handle must be gripped in a manner that is often awkward or uncomfortable for the user resulting in unwanted strain and causing pre-mature, user fatigue. Tool handles have been manufactured which are curved relative to the tool itself, see e.g. U.S. Pat. Nos. 6,487,747 and 5,974,775. However, such tool handles are typically of a fixed configuration. Although the selected configuration may facilitate use of the tool handle for a specific application, the fixed configuration limits use of the handle for other applications and does not permit the user to modify the handle configuration to accommodate the manner in which they might prefer to grip the tool depending upon the application for which it is to be utilized.

There remains a need for a tool handle which is comfortable to hold and grip in a wide range of applications.

SUMMARY OF THE INVENTION

The present invention comprises a tool handle assembly adapted to be connected to a tool head. The tool handle assembly includes a leg or leg assembly with first and second ends, an outer grip handle connected to the first end of the leg assembly, an inner grip handle connected to the leg assembly between the first and second ends and a tool head connector connected to the second end of the leg assembly. The outer grip handle preferably pivots about an axis extending perpendicular to an axis extending through the leg assembly. The inner grip handle preferably pivots between a storage position against the leg assembly and an operating position extending outward from the leg assembly. The inner grip handle may also be slidably mounted to the leg assembly. The tool head connector member is adapted to be connected to a plurality of selected tool heads to permit one tool handle to be used with a wide range of tool heads. The leg assembly of the tool handle preferably telescopes and comprises a pair of parallel extending legs connected together by cross-members.

DETAILED DESCRIPTION OF THE PREFERRED EMBODIMENTS

Figure 1:
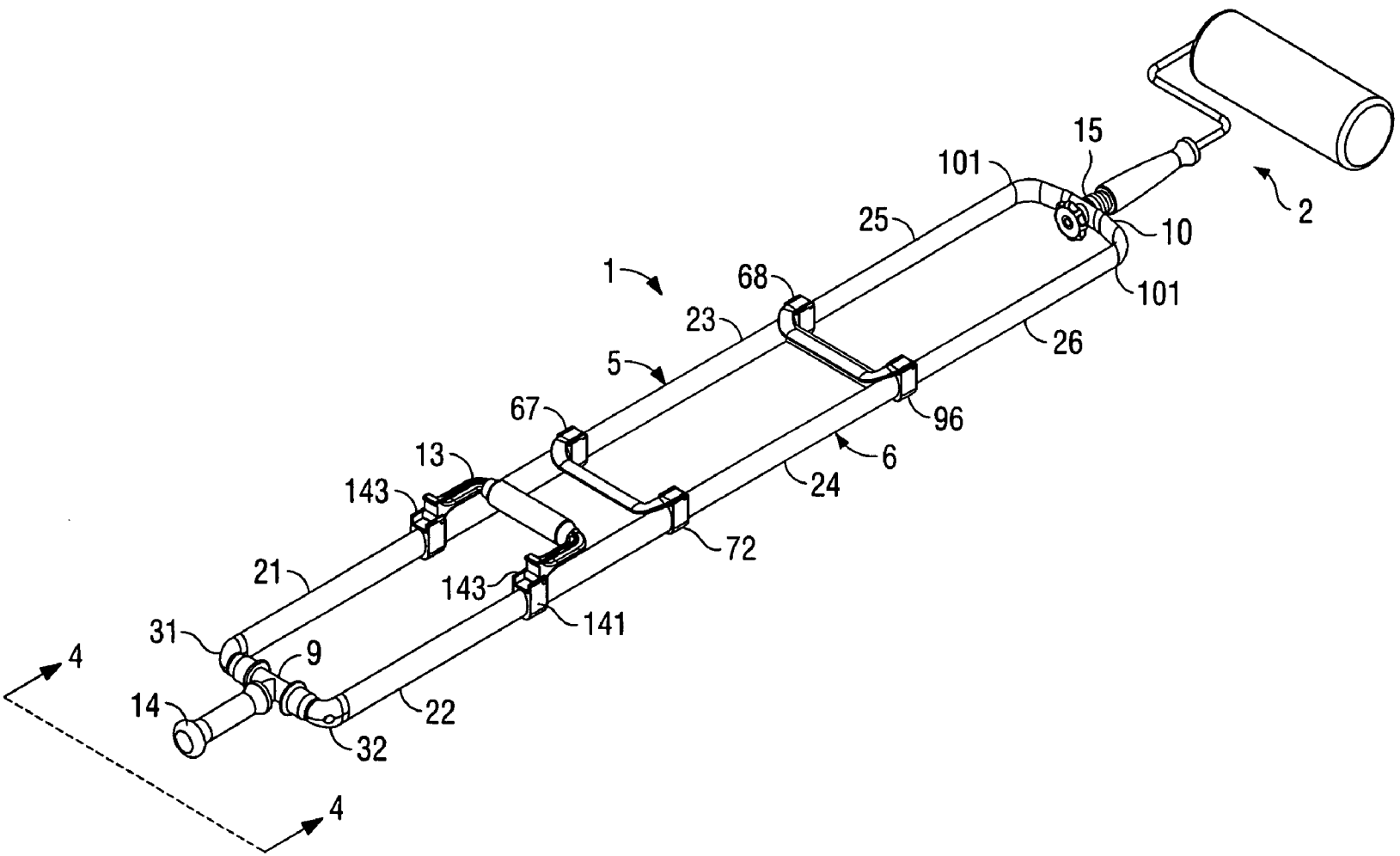
FIG. 1 is a perspective view of a tool handle assembly shown in a fully extended position and secured to a tool head comprising a paint roller.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import. In addition, as used in the claims, the words connected to, attached to, mounted on or similar words describing relationship of parts shall not necessarily be limited to a direct connection, attachment or mounting unless specifically indicated. Such terms are intended to include connections or the like involving intervening parts or structure as reasonable within the context of their usage in the claims.

Figure 2:
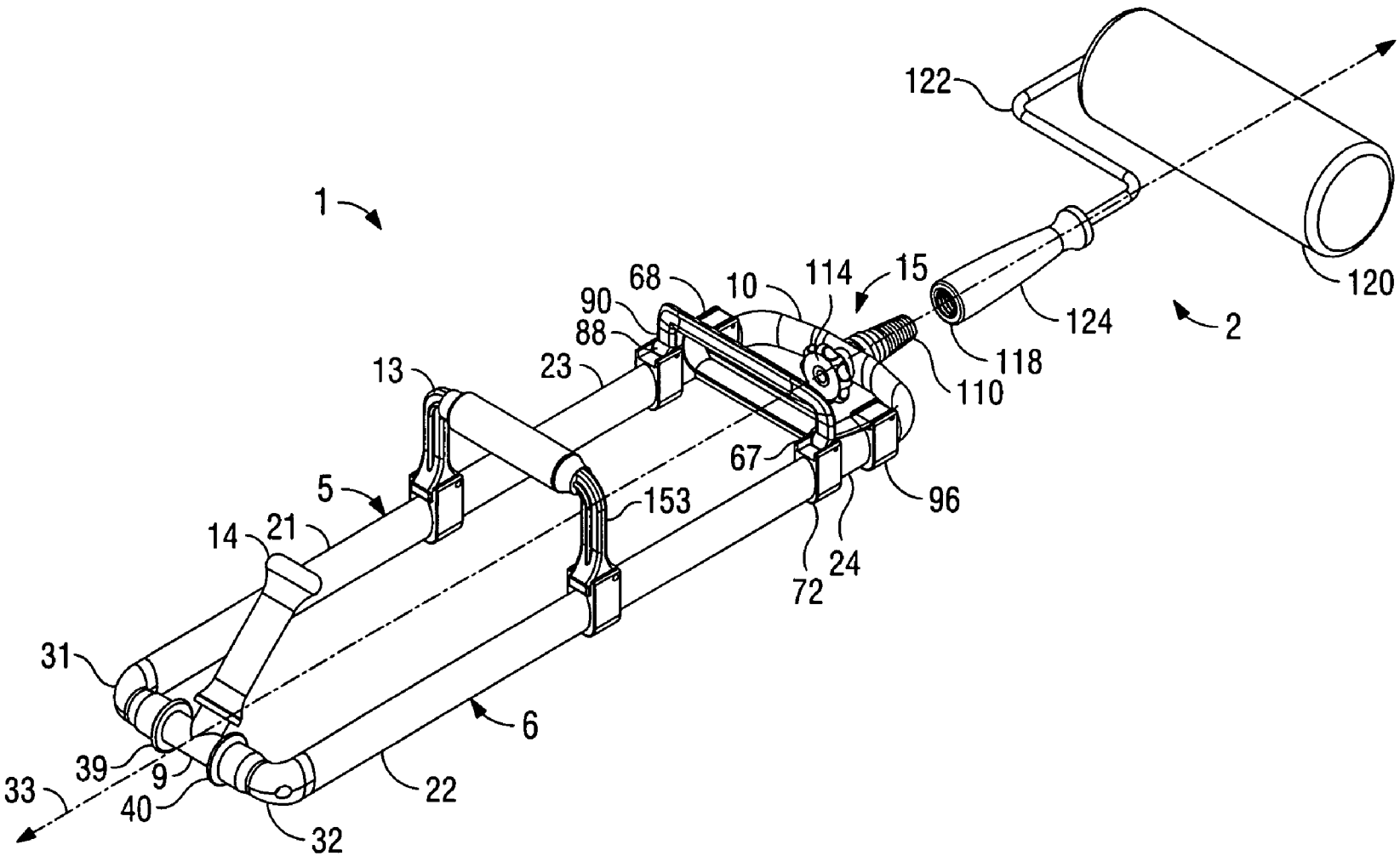
FIG. 2 is an enlarged, exploded perspective view of the tool handle assembly connected to the tool head and shown in a retracted position.

Referring to the drawings in more detail, with specific reference to FIGS. 1 and 2, the reference number 1 generally designates an adjustable tool handle with a tool head 2, in the form of a paint roller, secured thereto. The tool handle 1 generally comprises first and second telescoping leg assemblies 5 and 6, first and second cross-members 9 and 10, inner grip handle 13, outer grip handle 14 and tool head connector assembly 15.

Figure 3:
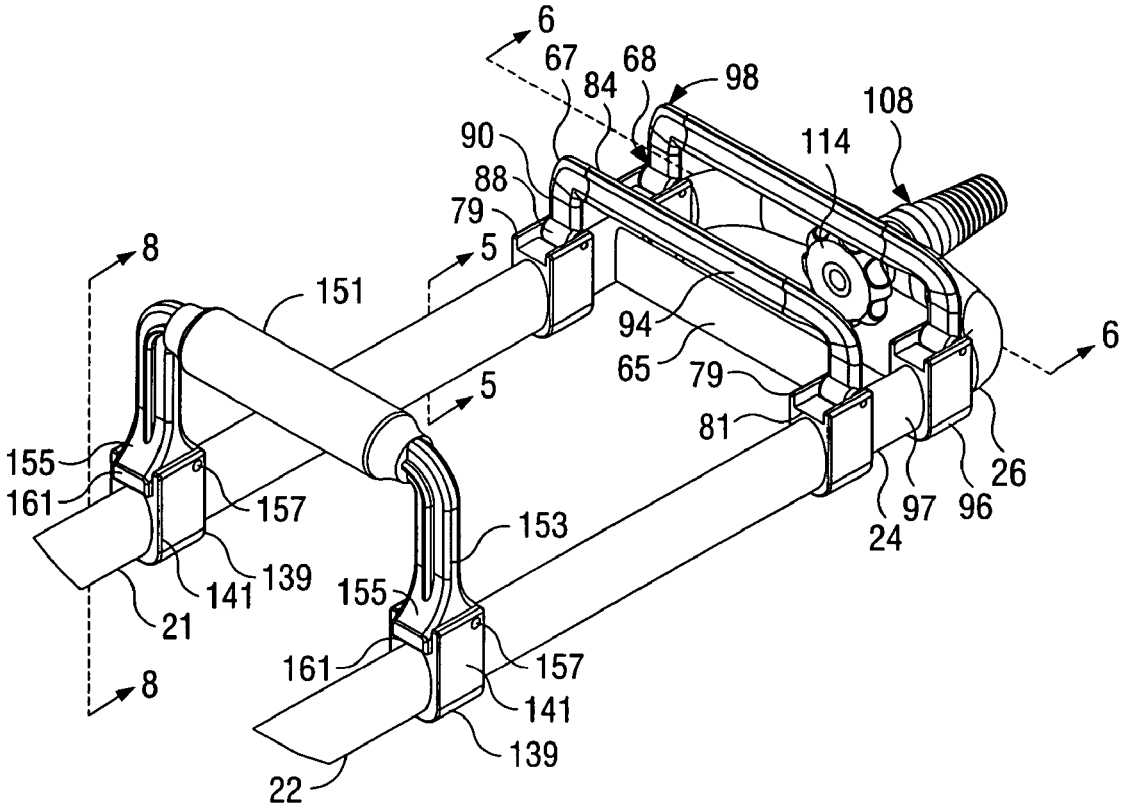
FIG. 3 is a further enlarged, fragmentary perspective view of the tool handle assembly.

As generally shown in FIGS. 1–3, each of the telescoping leg assemblies 5 and 6 includes three sets of telescoping tubes, namely, left and right outer tubes 21 and 22, left and right middle tubes 23 and 24 and left and right inner tubes 25 and 26. The left and right outer tubes 21 and 22 each have an inwardly directed elbows 31 and 32 formed or secured on a first end 34 of each of the outer tubes 21 and 22. The first end 34 of the outer tubes 21 and 22 also comprises a first end of the left and right telescoping leg assemblies 5 and 6. A tool handle axis 33 generally extends through the center of the telescoping leg assemblies 5 and 6 in axial alignment with the tool head connector assembly 15.

Figure 4:
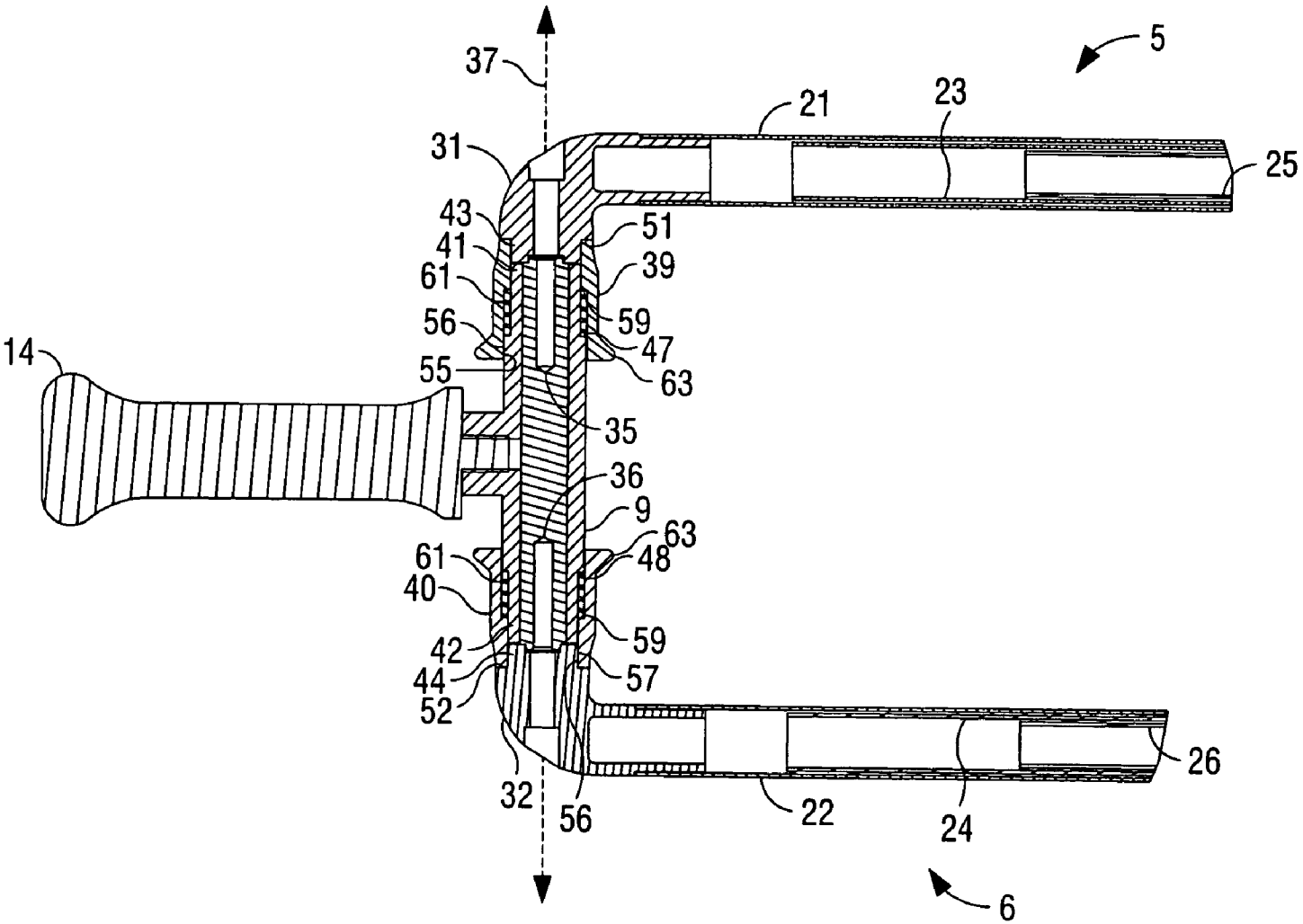
FIG. 4 is an enlarged and fragmentary cross-sectional view taken along line 2—2 of FIG. 1 and showing the connection of an outer grip handle to the tool handle assembly.

Referring to FIG. 4, first cross member 9 is rotatably mounted between the inwardly directed elbows 31 and 32 of the left and right outer tubes 21 and 22. The cross member 9 is rotatably mounted on pins 35 and 36 extending inward from the elbows 31 and 32 respectively. The outer grip handle 14 is connected to and extends perpendicular to the first cross-member 9 and the outer grip handle 14 rotates with the first cross-member 9 about a pivot axis 37 extending through the first cross-member 9 and perpendicular to the tool handle axis 33. Locking collars 39 and 40, slidingly mounted on outer ends 41 and 42 of the first cross-member 9, biasingly engage locking hubs 43 and 44 formed on the elbows 31 and 32 respectively to fix or secure the position of the outer grip handle 14 in a selected rotational orientation relative to the axis through the first cross member 9.

The cross-sectional shape of the locking hubs 43 and 44 and of the first cross-member outer ends 41 and 42 are octagonal and of the same size. Outwardly directed shoulders 47 and 48 are formed at the interface between the first cross-member outer ends 41 and 42 and a cylindrical center section 49 of the first cross-member 9. Similarly inwardly directed shoulders 51 and 52 are formed at the interface between the locking hubs 43 and 44 and the elbows 31 and 32. An inner portion 55 of an inner surface 56 of each of the locking collars 39 and 40 is cylindrical and slightly larger in diameter than the cylindrical center section 49. An outer portion 57 of the inner surface 56 of each of the locking collars 39 and 40 is also octagonal and slightly larger in cross-section than the outer periphery of the locking hubs 43 and 44 and the first cross-member outer ends 41 and 42. An inwardly directed rim 59 is formed on each collar 39 and 40 at the interface between the inner and outer portions 55 and 57.

A spring 61 is positioned between the inwardly directed rim 59 on each of the locking collars 39 and 40 and the associated outwardly directed shoulder 47 and 48 on the first cross-member 9 to urge the locking collars 39 and 40 outward. Gripping flanges 63 are formed on inner edges of each of the locking collars 39 and 40. The relative position of the outer grip handle 14 can be changed by first grasping the gripping flanges 63 and sliding the locking collars 39 and 40 inward against the biasing force of the spring 61 until the inner surface outer portion 57 of each locking collar 39 and 40 is drawn away from the respective locking hub 43 and 44. The outer grip handle 14 is then rotated to the desired alignment, and until the faces on the octagonal cross-member outer ends 41 and 42 are aligned with the faces on the octagonal locking hubs 43 and 44. The locking collars 39 and 40 are then released and the springs 61 drive the locking collars 39 and 40 outward until the outer ends of the locking collars abut against the inwardly directed shoulders 51 and 52 on the elbows 31 and 32. Engagement of the octagonal outer portion 57 of the locking collar inner surfaces 56 against the octagonal outer surface of the locking hubs 43 and 44 prevents the grip handle 14 and first cross-member 9 from rotating.

The octagonal configuration of the locking hubs 43 and 44 and the outer portion 57 of the inner surface 56 of the locking collars 39 and 40 permits the outer grip handle 14 to be positioned in eight different orientations relative to the leg assemblies 5 and 6 at forty-five degree intervals. The shape of the lacking hubs 43 and 44 and the outer portion 57 of the locking collar inner surfaces 56 can be varied to increase or decrease the number of rotational positions at which the outer grip handle 14 can be positioned. It is also foreseen that other means for securing the outer grip handle in it selected rotational orientation relative to the axis of the first cross member could be utilized. For example, a clamping type connection could be utilized to fix the rotational orientation of the outer grip handle 14 or a spring loaded detent type mechanism could be utilized.

Returning to the description of the leg assemblies 5 and 6 as shown in FIGS. 1–3, the left and right middle tubes 23 and 24 are slidingly secured within the left and right outer tubes 21 and 22. As best seen in FIG. 3, a third cross-member 65 is connected to and extends between the left and right middle tubes 23 and 24 of the leg assemblies 5 and 6 near the ends of the middle tubes 23 and 24 extending outside of the outer tubes 21 and 22. The third cross-member 65 provides support and rigidity between the middle tubes 23 and 24 and may be grasped by a user to help slide the middle tubes 23 and 24 relative to the outer tubes 21 and 22. The left and right inner tubes 25 and 26 are slidingly secured within the left and right middle tubes 23 and 24. A user may grasp the second cross-member 10, connected to inner tubes 25 and 26 and the third cross-member 65 to slide the inner tubes 25 and 26 relative to the middle tubes 23 and 24.

A first slide lock assembly 67 is connected to the left and right outer tubes 21 and 22 and selectively engages the left and right middle tubes 23 and 24 to fix their position relative to the outer tubes 21 and 22. Similarly, a second slide lock assembly 68 is connected to the left and right middle tubes 23 and 24 and selectively engages the left and right inner tubes 25 and 26 to fix their position relative to the middle tubes 23 and 24.

Figure 5:
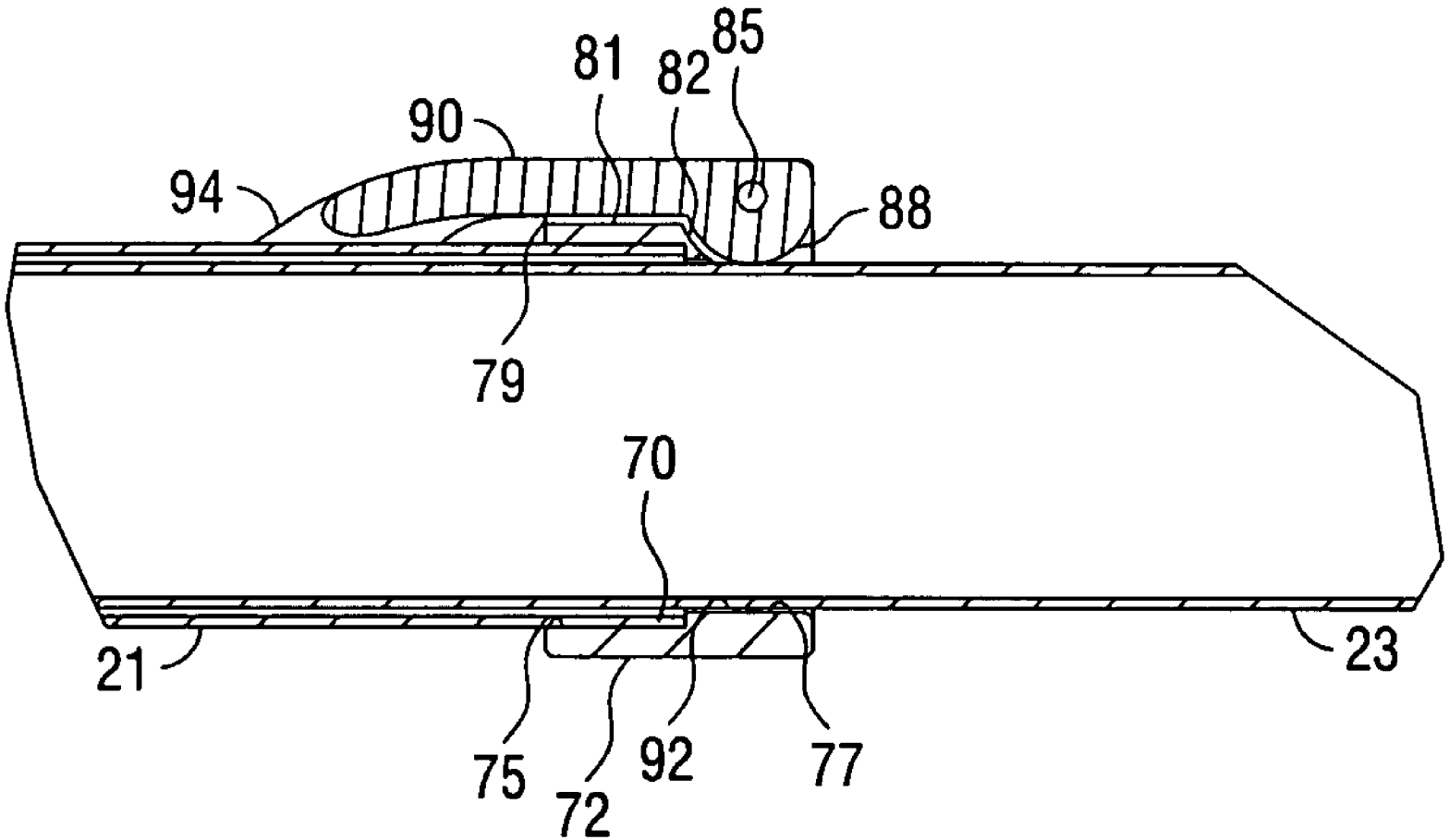
FIG. 5 is an enlarged and fragmentary cross-sectional view taken along line 5—5 of FIG. 3 showing a slide lock connected to a leg assembly of the tool handle assembly.

The first slide lock assembly 67 is mounted on open ends 70 of the left and right outer tubes 21 and 22. More specifically, mounting collars 72 are secured around the open ends 70 of the outer tubes 21 and 22. FIG. 5 shows a cross sectional view of a portion of the first slide lock assembly 67 secured to the open end 70 of the left outer tube 21 and will be used to describe the construction and operation of the first slide lock assembly 67. The portion of the slide lock assembly 67 secured to the right outer tube 22 is of the same construction.

Mounting collar 72 includes a first bore 75 extending into the collar 72 from a first side and a second bore 77 extending into the collar 72 from an opposite side and connected to the first bore 75. The first bore 75 is sized to snugly receive the open end 70 of the outer tube 21. The second bore 77 is generally sized slightly smaller in diameter than the first bore 75 but slightly larger in diameter than the outer diameter of the left middle tube 23.

A pair of flanges 79 project upward or outward from the mounting collar 72 generally above the outer tube 21, with the portion of the mounting collar 72 extending between the flanges 79 having a flat upper surface 81. A forward portion of the mounting collar 72 generally extending between the flanges 79 is cut away to form a cut-out or recess 82. A locking member 84 is pivotally secured between the flanges 79 by a pivot pin 85 extending through holes in the flanges 79. The locking member 84 comprises an eccentric cam 88 formed on the end thereof that is pivotally mounted to the flanges 79 and a lever arm 90 extending outward therefrom. The cam 88 generally extends into the recess 82 adjacent an upper surface of the left middle tube 23.

When the lever arm 90 is pivoted to an upright alignment, as shown in phantom lines in FIG. 5, the eccentric cam 88 does not engage or act on the middle tube 23. As the lever arm 90 is pivoted downward between the flanges 79, the widest portion of the eccentric cam 88 is rotated into engagement with the upper surface of the left middle tube 23, forcing the middle tube 23 downward into a tight frictional engagement with a lower inner surface of the mounting collar 72 or against a lower inner surface of the left outer tube 21 or against both, to resist further sliding of the middle tube 23 relative to the outer tube 21. The lever arm 90 may then be pivoted back to the upright alignment to take the eccentric cam 88 out of engagement with the middle tube 23 to permit sliding of the middle tube 23 relative to the outer tube 21. A bale 94 connects the lever arms 90 on the mounting collars 72 connected to the left and right outer tubes 21 and 22.

The second slide lock assembly 68 is formed of similar components as the first slide lock assembly 68 with mounting collars 96 connected to outer ends 97 of the middle tubes 23 and 24. Interconnected locking member 98 with eccentric cams 99 are pivotally mounted on the mounting collars 96 and selectively advanced into engagement with an upper surface of the inner tubes 25 and 26 to press the inner tubes 25 and 26 against the middle tubes 23 and 24 and fix the relative position of the inner tubes 25 and 26 to the middle tubes 23 and 24.

The left and right inner tubes 25 and 26 are connected together by the second cross-member 10, and in the embodiment shown, are formed from a single length of tubing which is bent into the U-shape that is shown. The second cross-member 10 extends between the inner tubes 25 and 26 at their outer ends which may be described as the second end 101 of the telescoping leg assemblies 5 and 6.

Figure 6:
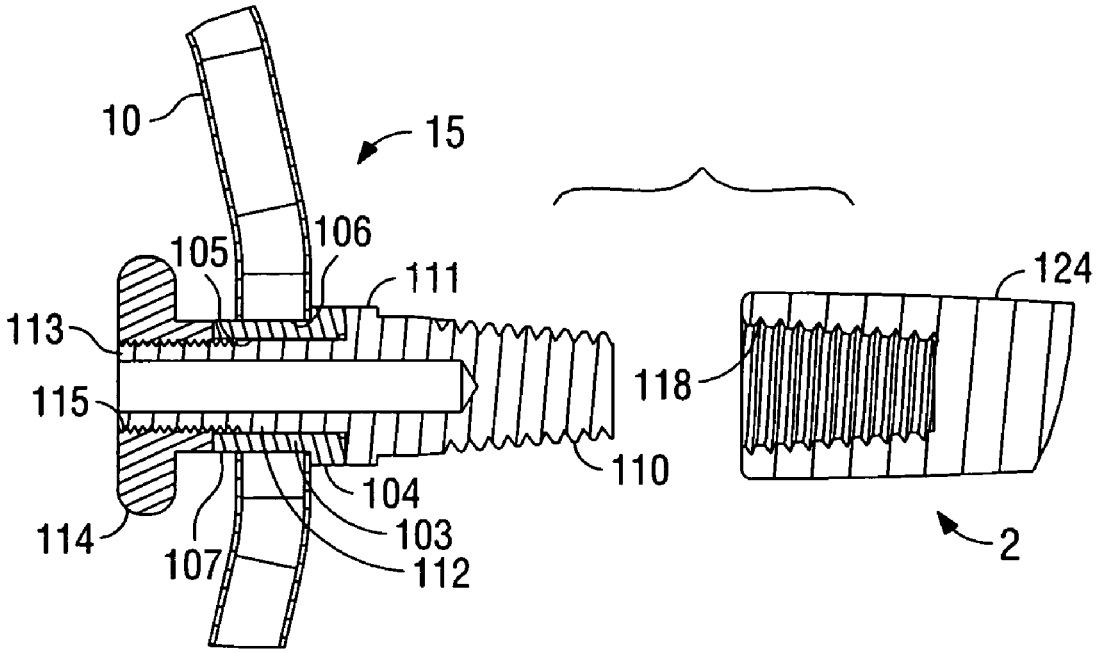
FIG. 6 is an enlarged, fragmentary and exploded cross-sectional view taken along line 6—6 of FIG. 3 showing a tool head connecting member connected to the tool handle assembly.

The tool head connector assembly 15, shown in cross-section in FIG. 6, is mounted on the second cross-member 10 preferably medially between the left and right leg assemblies 5 and 6. A flanged bearing sleeve 103 having an outer flange 104 formed on a first end and a bore 105 extending axially therethrough is secured in a hole 106 formed in the second cross-member 10 such that an inner end 107 of the sleeve 103 extends inward from an inner surface of the second cross-member 10. A tool head connecting member 108 is rotatably positioned in the bore 105 through the flanged bearing sleeve 103.

The tool head connecting member 108 includes an outer threaded connector 110 extending axially outward from a grooved collar 111, a cylindrical shaft 112, of reduced diameter extending axially inward from the grooved collar 111 and through the bore 105 in flanged bearing sleeve 103, and an inner threaded connector 113 generally extending in axial alignment inward from the cylindrical shaft 112. The inner threaded end 113 of tool head connecting member 108 extends inward past the inner end 107 of sleeve 103. A knob 114 is threadingly secured to the tool head connecting member 108 by threading of the inner threaded connector 113 through a threaded receiver 115 extending axially through knob 114.

The outer threaded connector 110 of the tool head connecting member 108 is sized for insertion into a threaded receiver 118 formed in the tool head 2. For example, the tool head 2 shown in the drawings comprises a paint roller. The paint roller 2 includes a cylindrical applicator 120 which is mounted on a shaft (not shown) which is rotatably mounted on a wire stem 122 which is connected to a handle or grip 124. It is conventional to form a threaded receiver 118 in the handle 124 of paint rollers. The threaded outer connector 110 of connecting member 108 is sized for use with such conventional paint rollers which can be screwed onto the connecting member 108.

Figure 7:
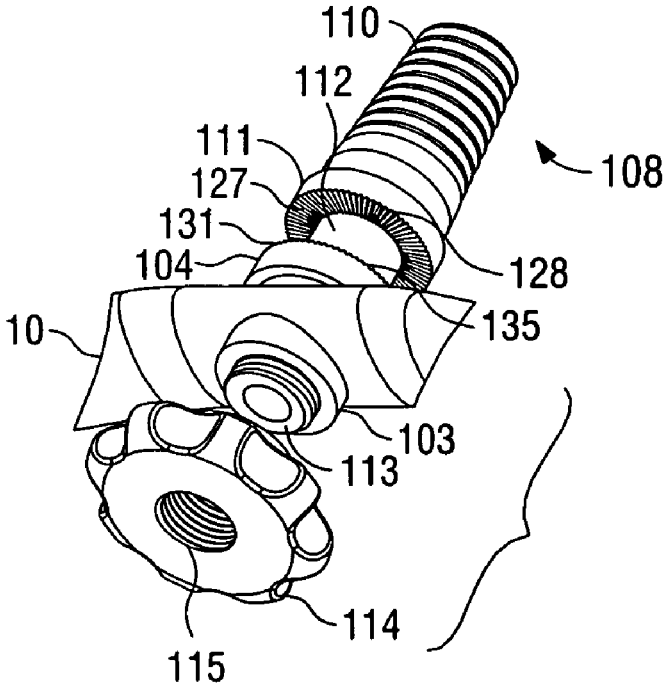
FIG. 7 is an enlarged, fragmentary and exploded perspective view of the tool head connecting member connected to the tool handle assembly.

When connecting the paint roller 2 to the tool handle 1, it is preferable that the axis of the applicator 120 extends parallel to a plane extending through the leg assemblies 5 and 6. Once the paint roller 2 is tightly threaded onto the connecting member 108, the rotational orientation of the connecting member 108 to the second cross-member 10 is adjustable to permit proper alignment of the tool head 2 with the handle 1. One possible means for permitting adjustable alignment of the tool head 2 with the handle 1 is shown in FIGS. 6 and 7. As shown in FIG. 7, an inner face 127 of the grooved collar 111 of connecting member 108 includes a plurality of alternating, and similarly sized ridges and grooves 128 extending radially outward from the cylindrical shaft 112. An outwardly directed face 131 of the flange 104 on bearing sleeve 103 includes a plurality of alternating, and similarly sized ridges and grooves 135 extending radially outward from the bore 105 of sleeve 103. The ridges and grooves 128 on inner face 127 of connecting member 108 are sized to interlock or mesh with the ridges and grooves 135 on the outwardly directed face 131 of the flange 104 when the connecting member 108 is drawn inward relative to the flanged bearing sleeve 103 by rotating the knob 114 clockwise relative to the inner threaded connector 113 on connecting member 108.

After the tool head 2 is secured to the connecting member 108, the connecting member 108 can be rotated to place the tool head 2 in the desired orientation relative to the handle 1, and then secured in its rotational orientation by turning knob 114, causing the opposed sets of ridges and grooves 128 and 135 to interlock to prevent the tool head 2 from rotating out of the selected orientation. The inner face 127 of collar 111 and outwardly directed face 131 of flange 104 preferably include a large number of relatively narrow ridges and grooves 128 and 135 to permit securement of the tool head 2 in a large number of orientations. It is foreseen that other systems could be utilized to permit selected rotational orientation of the tool head 2 relative to the tool handle 1 after the tool head 2 is attached to the connecting member 108 (or directly to the handle 1) including use of compression type systems or clutches or wedge type systems which might permit infinite adjustability of the rotational orientation of the tool head 2.

It is foreseen that connection means other than the threaded connector 110 on the tool handle 1 and threaded receiver 118 on the tool head 2 could be utilized to connect the tool head 2 to the handle 1. For example, a non-threaded outer end of the tool head connecting member 108 could include a spring loaded ball detent cooperating with a mating hole in a non-threaded receiver in the tool head 2 to lock the tool head 2 onto the connecting member 108 when the connecting member is inserted into the receiver of the tool head 2.

Figure 8:
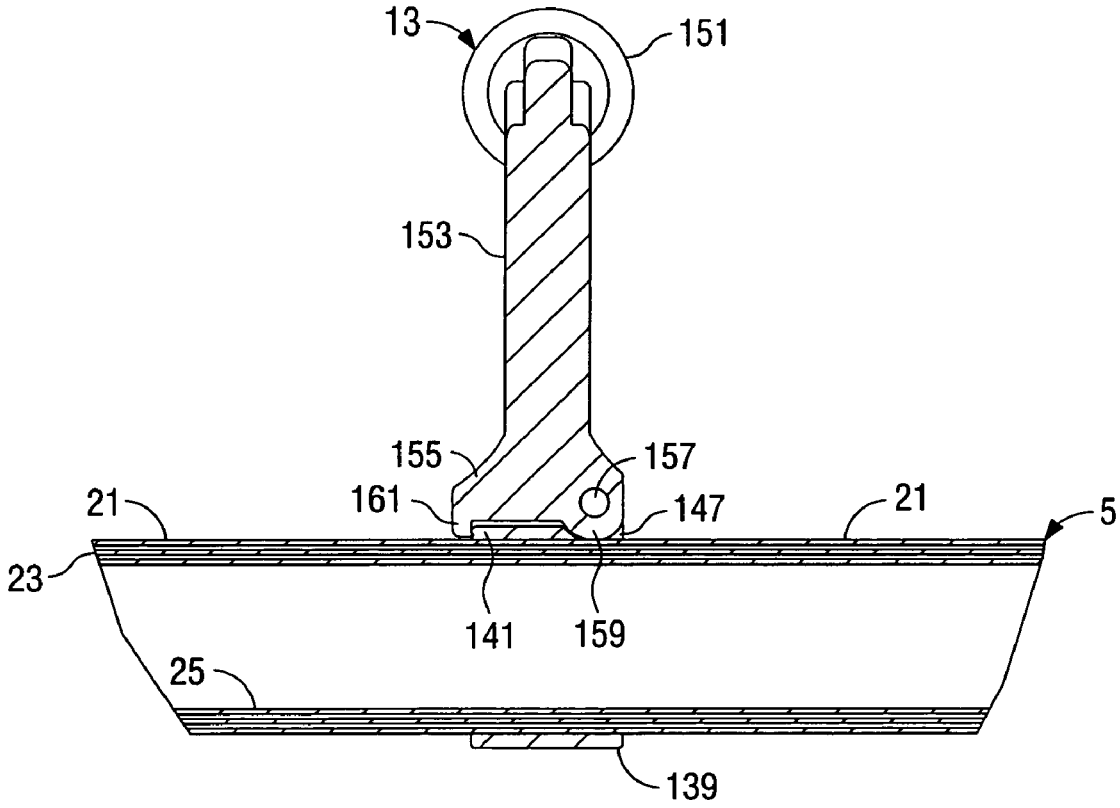
FIG. 8 is an enlarged and fragmentary cross-sectional view taken along line 8—8 of FIG. 3 showing an inner grip handle connected to the leg assembly of the tool handle.

Referring again to FIGS. 1–3 and to FIG. 8, the inner grip handle 13 is slidably secured to the left and right outer tubes 21 and 22. The inner grip handle 13 is attached to two handle mounting bases 139, one each secured to the left and right outer tubes 21 and 22 of the leg assemblies 5 and 6. Each of the handle mounting bases 139 comprises a sleeve 141 sized to frictionally engage the outer tube 21 or 22 over which it is secured. A pair of handle mounting flanges 143 (see FIG. 1) extend upward from each sleeve 141 generally above the outer tubes 21 or 22 to which the sleeve 141 is secured. A portion of the sleeve 141 extending between the flanges 143 on the side closest the tool head connecting assembly 15 is cut-away to form an open area 147 which is open to an upper surface of the outer tubes 21 or 22.

The inner grip handle 13 includes a grip 151, two legs 153 extending transverse to the grip 151 on opposite ends thereof, and a foot 155 formed on the end of each leg 153 opposite the grip 151. The feet 155 are pivotally connected to the flanges 143 on the handle mounting bases 139 by a pivot pin 157. A cam 159 is formed on the lower surface of each foot 155 adjacent the pivot pin 157 and extends into the open area 147 between the flanges 143 of handle mounting base 139. A catch 161 is formed on a side of the foot opposite the pivot pin 157 and cam 159. Referring to FIG. 1, the grip handle 13 is shown in a storage position wherein the legs 153 of the grip handle 13 generally extend parallel to and against the leg assemblies 5 and 6. The grip handle 13 can be pivoted about pivot pins 157 from the storage position shown in FIG. 1 to an operating position as shown in FIGS. 2 and 8. As the grip handle 13 is pivoted to the operating position, the cams 159 are rotated just past a widest portion thereof and in frictional engagement with the upper surface of tubes 21 and 22 to resist advancement of the grip handle 13 back to the storage position and to further resist sliding of the handle mounting bases 139 and grip handle 13 relative to the legs 5 and 6. The catches 161 frictionally engage a rear face of the associated mounting base 139 when the grip handle 13 is advanced to the operating position, to assist in holding the handle 13 in the operating position during use and to resist advancement of the grip handle 13 to the storage position.

It is foreseen that a wide variety of locking means, catches or catch means could be utilized to accomplish this function or that the apparatus might not use the catches or other locking means. It is also foreseen that similar locking means or catches could be utilized to hold the grip handle 13 in the storage position and that the cams 159 also function as locking or catch means. It is also foreseen that the inner grip handle 13 could be selectively positionable and secured in place at various angles relative to the leg assemblies 5 and 6 other than just the operating position and the storage position.

The tool handle 1 described provides a user a wide degree of flexibility in configuring the tool handle 1 to accommodate the task to be performed while providing a handle that is comfortable to hold. For example, when using the tool handle 1 as a handle for a paint roller 2, the telescoping leg assemblies 5 and 6 may be extended to permit the tool handle to be lengthened to reach relatively high spots on a surface to be painted. Similarly the telescoping leg assemblies 5 and 6 may be collapsed to facilitate use of the paint roller 2 in relatively confined spaces.

The orientation of the outer grip handle 14 can also be adjusted to accommodate user preferences to either provide a more comfortable gripping orientation or to lengthen or shorten the overall length of the tool handle 1. For example, in relatively confined spaces the outer grip handle 14 can be rotated and secured in position between the leg assemblies 5 and 6. It may be more comfortable for a painter to orient the outer grip handle 14 at an angle of approximately 45 degrees above the plane extending between the leg assemblies 5 and 6.

If the tool handle 1 is used in association with a broom, rake or hoe as the tool head 2, it may be more comfortable for the user to angle the outer grip handle 14 at an angle of approximately 135 degrees from below the plane extending between the leg assemblies 5 and 6. In this orientation, with the leg assemblies 5 and 6 of the tool handle 1 held at an angle of approximately 45 degrees relative to the ground during use, the outer grip handle 14 will extend generally horizontally relative to the ground. Such an orientation generally allows the user to grip the handle 1 more naturally or comfortably without undue strain on the arms, particularly with the orientation of grip 151 of the inner grip handle 13 extending generally perpendicular to the leg assemblies 5 and 6.

The orientation of the grip 151 extending perpendicular to the leg assemblies 5 and 6 also facilitates gripping of the tool handle 1 and use of the tool head 2 by a user. For example, the orientation of the user's hand on grip 151 makes it easier for the user to push the tool head 2 away from the user and against the surface on which the tool head 2 is working with less strain on the user's wrist, arm and shoulder. For example, the tool handle 1 permits a painter to push a paint roller 2 against a wall being painted with less strain on the wrist, shoulder and arms than with a conventional straight, rigid handle.

The ability to slide, or move the inner grip handle 13 relative to the left and right outer tubes 21 and 22 of the leg assemblies 5 and 6 also permits the user to position the inner grip handle 13 at a position which provides for a more comfortable grip and which can be adjusted depending on the application or work environment. It is also foreseen, that in certain applications, the ability to orient the tool head 2 at a selected angle relative to the tool handle 1 using the tool head connecting member 8 could facilitate use of the tool head 2.

It is to be understood that while certain forms of the present invention have been illustrated and described herein, it is not to be limited to the specific forms or arrangement of parts described and shown. It is to be understood that equivalents may be employed and substitutions made herein without departing from the scope of the invention as claimed. For example, although the tool handle assembly shown is formed from a pair of telescoping leg assemblies, it is to be understood that the tool handle assembly could be formed from a single leg or leg assembly, with an inner grip handle generally mounted perpendicular to the leg and an outer grip handle pivotally mounted on the end of the leg opposite the tool head. It is also to be understood that the pair of leg assemblies 5 and 6 could be referred to as a leg, with the tool handle axis extending between the leg assemblies 5 and 6 in parallel relation thereto.

What is claimed and desired to be secured by Letters patent is as followed:

1. A tool handle adapted to be connected to a tool head, said handle comprising:

a) first and second legs, each of said legs having a first end and a second end and portions of said first and second legs extending in parallel relation, b) a first cross-member extending between said first and second legs proximate said first ends thereof;

c) a second cross-member extending between said first and second legs proximate said second ends thereof;

d) a tool head connector connected to said second cross-member between said first and second legs and projecting outward therefrom; said tool head connector adapted for connecting a tool head thereto; and e) an inner grip handle pivotally mounted on sliding connectors which are slidingly connected to said first and second legs such that said inner grip handle is slidable toward and away from said second cross-member and said inner grip handle is pivotable between a retracted position and an operating position, in said operating positions said inner grip handle extends outward from a plane defined by said portions of said first and second legs extending in parallel relation.

2. The tool handle as in claim 1 wherein each of said sliding connectors comprises a sleeve at least partially surrounding said first and second legs respectively.

3. A tool handle adapted to be connected to a tool head, said handle comprising:

a) first and second legs, each of said legs having a first end and a second end;

b) a first cross-member extending between said first and second legs proximate said first ends thereof;

c) a second cross-member extending between said first and second legs proximate said second ends thereof;

d) an inner grip handle slidably mounted on and extending between said first and second lees between said first and second ends thereof;

e) an outer grip handle mounted on said first cross-member between said first and second legs and extending perpendicular to said first cross-member; and f) a tool head connector mounted on said second cross-member between said first and second legs; said tool head connector including means for connecting a tool head thereto;

g) wherein said inner grip handle is pivotable between a first position and a second position, in said first position said inner grip handle is generally positioned against said first and second legs and in said second position said inner grip handle extends outward from a plane extending through said first and second legs of said tool handle.

4. The tool handle as in claim 3 wherein said first and second legs are formed from telescoping members to permit selective adjustment of the length of said tool handle.

5. The tool handle as in claim 4 wherein said first and second legs extend in parallel relation and said inner grip handle is connected to said first and second legs by a sliding connector so as to be moveable toward and away from said first cross-member.

6. A tool handle adapted to be connected to a tool head, said handle comprising:

a) first and second legs, each of said legs having a first end and a second end;

b) a first cross-member extending between said first and second legs proximate said first ends thereof;

c) a second cross-member extending between said first and second legs proximate said second ends thereof;

d) an inner grip handle slidably mounted on and extending between said first and second legs between said first and second ends thereof;

e) an outer grip handle mounted on said first cross-member between said first and second legs and extending perpendicular to said first cross-member; and f) a tool head connector mounted on said second cross-member between said first and second legs; said tool head connector including means for connecting a tool head thereto g) wherein said outer grip handle selectively rotates about an axis extending through said first cross-member.

7. The tool handle as in claim 6 further comprising means for securing said outer grip handle in a finite set of selected rotational orientations relative to said first and second legs.

8. The tool handle as in claim 7 further comprising a locking member releasably securing said outer grip handle in a finite set of selected rotational orientations relative to said first and second legs.

9. A tool handle selectively securable to a plurality of tool heads, said tool handle comprising:

a) a telescope in leg assembly having first and second ends;

b) a tool head connecting member located at a second end of said telescoping leg assembly and adapted for selectively and removably connecting a selected one of said plurality of tool heads to said tool handle;

c) an inner grip handle having a grip extending generally perpendicular to said telescoping leg assembly said inner grip handle connected to said telescoping leg assembly by a sliding connector; and d) an outer grip handle rotatably connected to said telescoping leg assembly proximate a first end of said telescoping leg assembly and said outer grip handle selectively rotating about a pivot axis extending approximately perpendicular to a tool handle axis generally extending through said first and second ends of said telescoping leg assembly.

10. A tool handle adapted to be connected to a tool head, said tool handle comprising:

a) first and second legs, each of said legs having a first end and a second end;

b) a first cross-member extending between said first and second legs proximate said first ends thereof;

c) a second cross-member extending between said first and second legs proximate said second ends thereof;

d) an inner grip handle connected to and extending between said first and second legs between said first and second ends thereof;

e) an outer grip handle mounted on said first cross-member between said first and second legs and extending approximately perpendicular to said first cross-member, wherein said outer grip handle selectively rotates about an axis extending through said first cross-member; and f) a tool head connector mounted on said second cross-member in planar alignment with said outer grip handle in a plane extending perpendicular to the first and second cross-members; said tool head connector adapted for connecting a tool head thereto.

11. A tool handle selectively securable to a plurality of tool heads, said tool handle comprising:

a) a telescoping leg assembly having first and second ends;

b) a tool head connecting member located at a second end of said telescoping leg assembly and adapted for selectively and removably connecting a selected one of said plurality of tool heads to said tool handle;

c) an inner grip handle having a grip extending generally perpendicular to said telescoping leg assembly, said inner grip handle connected to said telescoping leg assembly by a sliding connector, and wherein said inner grip handle is pivotable between a first position and a second position, in said first position said inner grip handle is generally positioned against said telescoping leg assembly and in said second position said inner grip handle extends outward from said telescoping leg assembly.

12. A tool handle adapted to be connected to a tool head, said handle comprising:

a) first and second legs, each of said legs having a first end and a second end;

b) a first cross-member extending between said first and second legs proximate said first ends thereof;

c) a second cross-member extending between said first and second legs proximate said second ends thereof;

d) an inner grip handle connected to and extending between said first and second legs between said first and second ends thereof;

e) an outer grip handle connected to said first cross-member and extending approximately perpendicular to said first cross-member;

f) a tool head connector connected to said second cross-member; said tool head connector adapted for connecting a tool head thereto;

g) a connecting member having a threaded outer end for threading into a threaded receiver in a tool head; and h) wherein said connecting member is rotatably connected to said second cross-member and securable in a selected rotational orientation relative to said second cross-member to allow alignment of said tool head with said tool handle.

13. A tool handle adapted to be connected to a tool head, said tool handle comprising:

a) a leg having a first end and a second end and adapted for connection to a tool head at said second end;

b) an inner grip handle connected to said leg between said first and second ends and having an inner hand grip extending generally perpendicular to said leg;

c) an outer grip handle rotatably connected to said leg proximate said first end and rotatable about a pivot axis extending approximately perpendicular to a tool handle axis generally extending through said first and second ends of said leg;

d) a tool head connecting member having a threaded outer end for threading into a threaded receiver in a tool head; and e) wherein said connecting member is rotatably connected to said leg at said second end and securable in a selected rotational orientation relative to said second cross-member to allow alignment of said tool head with said tool handle.

* * * * *